United States Patent [19]

Kin et al.

[11] Patent Number: 4,575,343

[45] Date of Patent: Mar. 11, 1986

[54] BIMETAL ELECTRODE AND METHOD OF MAKING SAME

[75] Inventors: Nelson I. Kin; George T. Payne, both of Tiffin, Ohio

[73] Assignee: The National Machinery Company, Tiffin, Ohio

[21] Appl. No.: 232,954

[22] Filed: Feb. 9, 1981

Related U.S. Application Data

[63] Continuation-in-part of Ser. No. 138,500, Apr. 9, 1980, abandoned.

[51] Int. Cl.[4] ..... H01T 21/02

[52] U.S. Cl. ..... 445/7; 72/258; 313/141; 445/49

[58] Field of Search ..... 29/25.12, 422, 511; 72/258; 313/141

[56] References Cited

U.S. PATENT DOCUMENTS

| | | | |
|---|---|---|---|
| 2,849,788 | 9/1958 | Creek | 29/156.8 R |
| 2,945,293 | 7/1960 | Last | 29/511 X |
| 2,955,222 | 10/1960 | Beesch | 29/25.12 X |
| 3,040,417 | 6/1962 | Newton | 29/422 X |
| 3,144,576 | 8/1964 | Hagmaier et al. | 29/25.12 X |
| 3,356,882 | 12/1967 | Hallaver et al. | 313/141 |
| 3,548,472 | 12/1970 | Urushiwara et al. | 29/25.12 |
| 3,818,555 | 6/1974 | Yamaguchi et al. | 29/25.12 |
| 3,857,145 | 12/1974 | Yamaguchi et al. | 29/25.12 |

FOREIGN PATENT DOCUMENTS

| | | | |
|---|---|---|---|
| 1052781 | 3/1959 | Fed. Rep. of Germany | 72/258 |
| 2024665 | 7/1980 | United Kingdom | 29/25.12 |

*Primary Examiner*—Kenneth J. Ramsey

*Attorney, Agent, or Firm*—Pearne, Gordon, Sessions, McCoy, Granger & Tilberry

[57] ABSTRACT

A method of producing bimetal electrodes is disclosed in which a core of one metal is positioned within a cup of another metal so that the core is recessed back from the open end of the cup. In two embodiments, where the core is fully encapsulated, the open end of the cup is initially bottled or bent inward and subsequently the assembly is pressed through an extrusion die with a tool having a nose with an area substantially equal to the area of the core. In one such embodiment, a weld lug is produced by said tool during the extrusion. Such tool completes the closing of the open end of the cup to fully encapsulate the core and applies the principal extrusion force through the closed end to the core and from the core to the forward end or originally closed end of the cup. Subsequently, the extruded part is trimmed and additionally worked as required. In another embodiment, similar tooling is provided to produce an electrode in which the core is not fully encapsulated. In such embodiment, the cup is not bottled prior to the extrusion operation.

23 Claims, 23 Drawing Figures

BIMETAL ELECTRODE AND METHOD OF MAKING SAME

BACKGROUND OF THE INVENTION

This is a continuation-in-part of copending application Ser. No. 138,500, filed Apr. 9, 1980 (now abandoned).

This invention relates generally to electrodes and, more particularly, to a novel and improved bimetal electrode for spark plugs or the like, and to a novel and improved method and apparatus for producing such electrodes.

PRIOR ART

Bimetal electrodes for spark plugs or the like, are known. Such electrodes normally provide a core, usually copper, which is encased at least to a substantial extent in an outer layer, usually nickel. In most instances, the procedure for producing such electrodes has involved an assembly of parts, one nickel and the other copper, and the simultaneous extrusion of such assembly. After extrusion, finishing operations have been performed.

A number of patents describe various procedures and products of this type. Such patents include U.S. Pat. Nos. 2,955,222; 3,144,576; 3,356,882; 3,548,472; 3,803,892; 3,818,555; and 3,857,145.

Some of such patents describe processes in which two flat discs, one of each metal, are simultaneously extruded. With such procedures, the rearward end of the copper core material tends to extend a substantial distance beyond the end of the outer nickel layer.

Other of such patents involve the assembly of a nickel cup and a piece of copper, usually formed with a head portion above the open end of the cup, and a reduced diameter portion extending into the cup. Here again, after extrusion, such processes produce a part where a substantial amount of copper extends beyond the end of the nickel cladding.

In such electrodes, there is a tendency for a gap to occur at the junction between the inner end of the copper and the nickel. It is believed that such gap or void results from the fact that the nickel tends to elongate during the extrusion operation and pulls away from the copper which is also moving through the extrusion die.

In still other of such patents, the electrode is formed of a bimetal, wirelike material having a copper core clad with a sheath of nickel. Such procedures usually require welding to enclose one or both ends of the electrode.

SUMMARY OF INVENTION

There are a number of aspects to the present invention. In accordance with one aspect of this invention, a system is provided to virtually eliminate the presence of any void between the inner end of the copper core and the adjacent nickel.

In accordance with another aspect of this invention, a bimetal electrode is formed from an assembly of a cup and a slug in which the slug does not project beyond the end of the cup. With such structure, and after extrusion, the core material does not project beyond the end of the cladding material. In fact, in accordance with the illustrated embodiments of this invention, the slug is shorter than the cup depth and is recessed from the open cup end when the core and cup are assembled.

Preferably after assembly, the core material is subjected to a preseating operation in which the relatively soft copper material is deformed under pressure within the cup to conform to the cup shape and to eliminate the presence of any voids between the end of the core and the inner surface of the bottom of the cup.

In each illustrated embodiment, the assembled cup and core is subjected to an extruding operation in which the force producing the extrusion is concentrated centrally along the center of the assembly to ensure that separation does not occur between the inner end of the core and the adjacent portions of the cup during the extrusion operation.

In two of the embodiments illustrated, the core material is completely encapsulated in the cladding material. Such complete encapsulation is accomplished without separate welding required by the prior art. In the fully encapsulated embodiments, the assembled cup and slug are "bottled" to deform the open end of the cup inwardly while leaving an opening within the cup edges. Subsequently, the bottled part is pushed through an extrusion die with a tool having a reducing diameter nose projecting from its end. The nose engages the bottled or inturned edges and deforms them down against the end of the copper core. With this structure, extremely high pressure is localized at the center of the part where the edges of the open end of the cup meet and the pressure is sufficient to create a full closure to completely encapsulate the core. Further, because the pressure is concentrated near the center of the assembly in alignment with the core material, sufficient force is supplied to the core to ensure that a void or separation does not occur between the inner end of the core and the adjacent portion of the cladding material. In such encapsulated embodiment, the end is trimmed and coined after the extrusion to produce the finished electrode having a well defined head and a fully encapsulated core.

In one of the fully encapsulated embodiments, the reduced diameter nose on the tool is flat and the central end portion formed by the nose is therefore flat. After trimming, the product of this embodiment has a flat end.

In the other of the fully encapsulated embodiments, a small central recess is provided in the reduced diameter nose of the tool. Such recess produces a small weld lug at the end of the electrode which projects beyond the end face after the trimming operation. In this embodiment, the force on the core is again sufficient to ensure that voids to not occur at the opposite end.

In another embodiment of this invention which is illustrated, the core material is not fully encapsulated. Instead, the core material is exposed at the nonfiring end of the electrode. In such embodiment, the assembled core and cup are not bottled, but the extrusion is produced by a punch which engages the end of the slug or core and provides the medium for transmitting most of the extrusion force to the lower end or closed end of the cup. With such a structure, in which the extrusion force is provided primarily through the core material and wherein a lesser pressure or force is applied against the open end of the cup, extrusion is accomplished without the occurrence of significant voids at the lower ends of the cores.

In this embodiment in which the core material is not encapsulated, subsequent forming operations include trimming away excess cup material and subsequent forming operations as required to produce the final shape required on the electrode.

These and other aspects of the invention are more fully described in the following specification and drawings.

DETAILED DESCRIPTION OF THE DRAWINGS

Figure 1A:
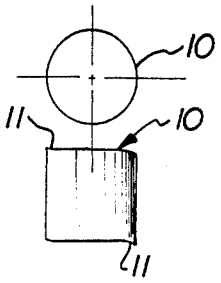
FIGS. 1*a* through 1*k* are views of the progression utilized to form an electrode in accordance with the first embodiment of this invention.

Referring to the drawings, several embodiments of this invention are illustrated, two of which result in the production of a bimetal spark plug electrode in which the core material, usually copper, is fully encapsulated. Another embodiment is disclosed in which the end of the core material remains exposed and the final electrode is structurally different at the nonfiring end from the other embodiments. In the drawings, most of the tooling is not illustrated since tooling, well understood by those skilled in the art, may be utilized to perform the operations required for shaping the parts to the final required shape. In some instances, however, illustrative tooling is illustrated, but it should be understood that other forms of progressions and tooling may, in some instances, be employed.

Figure 1B:
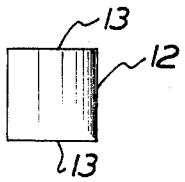
Figure 1C:
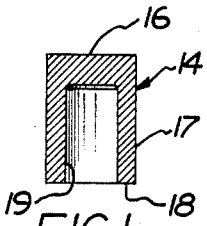

FIGS. 1*a* through 1*c* illustrate the progression of producing the cup which is formed of a heat-resistant material suitable for spark plug electrodes, such as nickel. As illustrated in FIG. 1*a*, a cylindrical slug or blank 10 is cut from the end of a piece of rod or stock. In such cutting operation, the ends of the blank are not completely square and have oppositely extending, tapered sections 11 caused by the shearing operation itself.

The unevenness on the ends of the slug 10 is removed in the first squaring operation, the final product of which is illustrated in FIG. 1*b*. In this FIG., the squared blank 12 has a diameter substantially the same as the blank or slug 10, but the ends 13 are essentially square and flat. Tooling for squaring the slug has not been illustrated, but normally include a die size to receive the blank having a square inner end provided at least in part by an ejector pin and a cooperating tool having a square end to cooperate with the die to produce the slug of FIG. 1*b*.

After the squaring operation, the slug 12 is formed into a cup-shaped element by backward extrusion and the cup is shaped as illustrated in FIG. 1*c*. Such cup 14 has an end wall 16 and a cylindrical side wall 17 extending from the end wall 16 to the outer or open end 18. The cup provides a cylindrical inner wall 19 extending to the end wall 16. Preferably, the cup 14 is formed in a single machine, such as a double-blow header, which operates automatically to cut the slugs 10 from wire stock and perform the squaring and extrusion operations sequentially in a single die during two strokes. It should be understood, however, that other forms of machines can be utilized for producing the cup.

From the forming operation in which the cup 14 is produced, the cups are transferred to a cleaning operation in which the cups are thoroughly cleaned to remove any lubricant or other foreign matter for the reasons discussed in greater detail below.

Figure 1D:
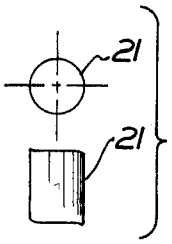
Figure 1E:
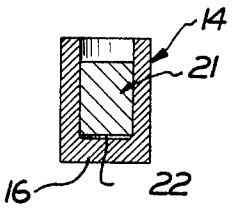

The core material, usually copper, is cut from wire stock to produce a core slug 21 illustrated in FIG. 1*b*. Here again, the core slug 21 is generally cylindrical, but the shearing operation results in an end surface which is not completely smooth or square. The slugs 21 are thoroughly washed to remove all foreign matter and oil or the like, and the slug 21 and cup 14 are assembled, preferably in an automatic assembling machine, to produce an assembly illustrated in FIG. 1*e*. Preferably, the slug 21 is sized to closely fit the cylindrical opening 19 without interference. It should be noted that, as illustrated in FIG. 1*e*, a small clearance 22 tends to exist between the inner end of the core slug 21 and the end wall 16 of the cup-shaped blank 14. It is important to remove this space if the final electrode is to be formed without a void between the inner end of the copper core and the adjacent portion of the nickel material.

Figure 1F:
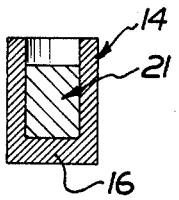

One procedure for accomplishing this is to preseat the slug 21 in the cup 14, as illustrated in FIG. 1*f*. This preseating is accomplished by placing the assembly of FIG. 1*e* within a die and pressing against the copper slug 21 with a tool sized to closely fit the opening 19 and provided with a square end. In this operation the cup shape is not changed. Relatively low forces can be used because the copper is relatively soft and the slug is relatively small in diameter. The force, however, should be sufficiently high to cause the copper to upset to tightly fill the cavity within the cup and to tightly engage the walls of the cavity. A force in the order of 80,000 to 100,000 pounds per square inch has been found to be sufficient to produce this upsetting of the copper and to accomplish the full preseating of the copper slug 21 within the nickel cup, but, of course, if the material forming the core slug is harder, larger upsetting forces would normally be required.

The cleaning of both the slug and the cup is important to prevent the presence of any foreign material or lubricating oil along the interfaces between the core slug 21 and the inner wall of the cup 14, and it is preferable to form the preseating operation of FIG. 1*f* without the presence of any significant lubricating oils or fluids so that the interface is clean. After preseating, tight mating engagement exists to prevent access of foreign matter.

As discussed above, several embodiments of this invention are disclosed. Two produce a fully encapsulated core, and another produces an electrode in which core material is exposed at the nonfiring end when the electrode is completed. All embodiments employ the progressions substantially as shown in FIGS. 1*a* through 1*f* and differ primarily in the progression of steps after the manufacture of the assemblage of FIG. 1*f*.

Figure 1G:
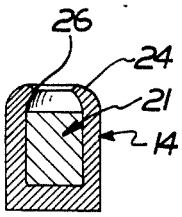

A first form of the first embodiment in which the core is fully encapsulated is in accordance with the progression illustrated in FIGS. 1*g* through 1*k*. In such progression, the assembly of FIG. 1*f* is bottled in that the portion of the cup 14 extending above the core 21 is bent inward, as illustrated in FIG. 1*g* at 24, to partially close the cup end over the core slug 21. The bottling operation, however, does not cause the open edges at 24 to completely close and an opening 26 still remains above the core slug 21.

Figure 1H:
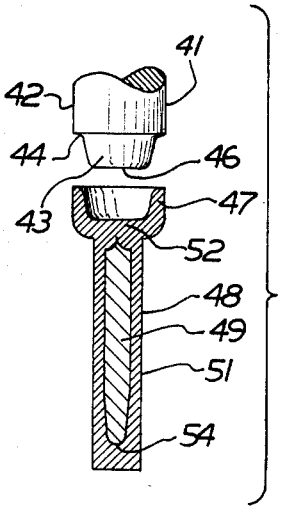
Figure 2:
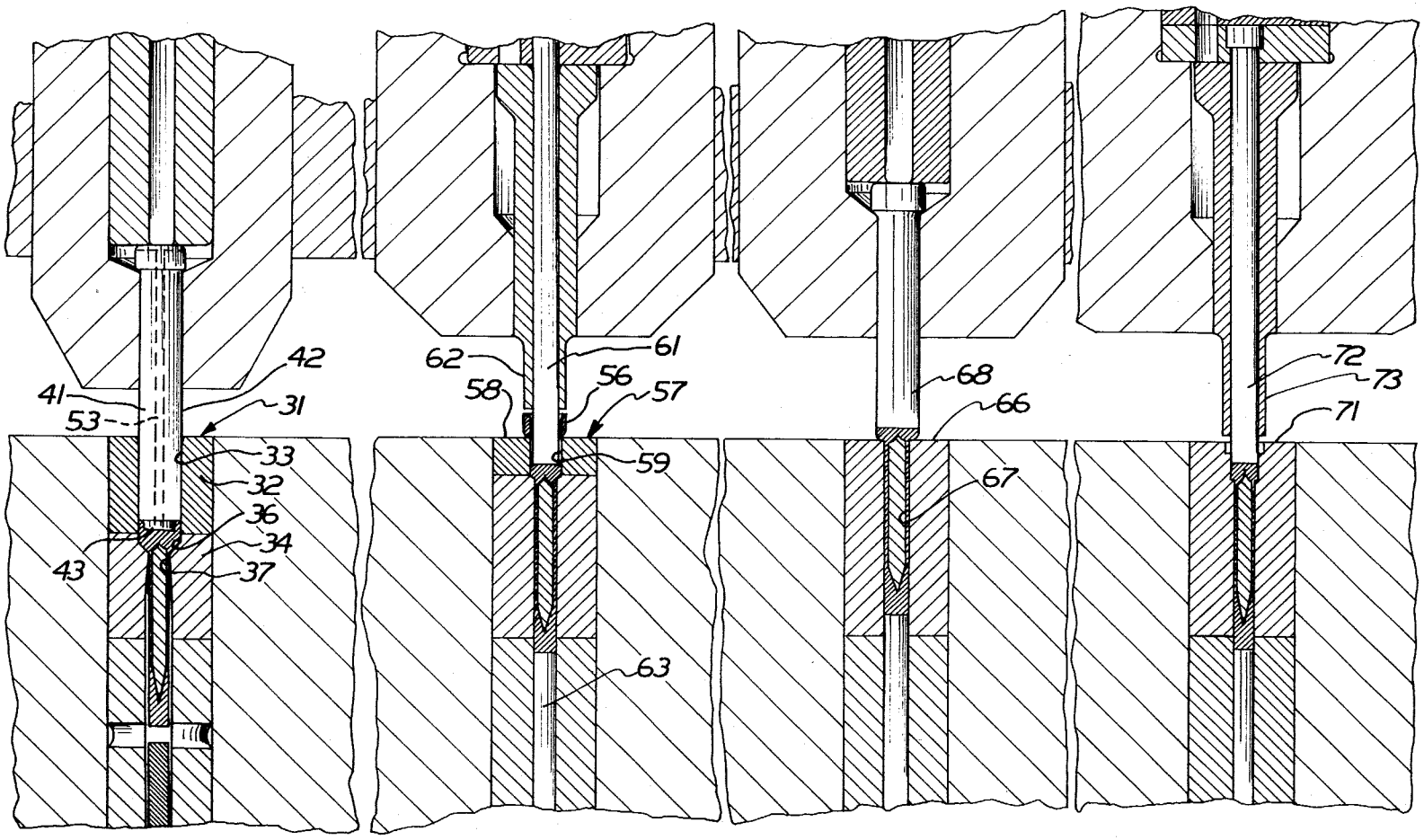
FIG. 2 illustrates one set of tooling utilized to progressively form the parts illustrated in FIGS. 1*h* through 1*k;*

Referring now to FIGS. 2 and 1*h*, the bottled assembly of FIG. 1*g* is inserted into an extrusion die assembly 31 consisting of an outer die member 32 having a cylindrical bore 33 proportioned to receive the bottled assembly with a close clearance. Inwardly of the outer die 32 is the extrusion die 34 per se having an entrance portion 36 and an extrusion throat 37. Beyond the extrusion throat 37 is a passage in the die slightly enlarged to ensure clearance.

A cooperating tool 41 is provided on the header slide and is movable toward the die assembly 31 to a forward dead-center position illustrated in FIG. 2. Such tool includes a cylindrical outer diameter 42 proportioned to fit the passage 33 with a relatively close fit and a reduced diameter nose 43. The end of the tool 42 is illustrated on an enlarged scale in FIG. 1*h*. In the illustrated embodiment, the tool 41 along its major diameter has a diameter of about 0.2 inch. The nose 43 has an end diameter of about 0.15 inch and is tapered back from the end at an angle of about 15 degrees or an included angle of 30 degrees. At the junction between the nose 43 and the major portion of the tool, a radius 44 is provided.

The diameter of the end face 46 of the tool is larger than the opening 26 provided in the bottled part. Consequently, the edges of the cup which are inturned during the bottling operation are initially engaged by the end face 46 of the tool, and are pressed inwardly into engagement with the outer end of the core 26. Preferably the diameter of the end face 46 is approximately equal to the diameter of the core slug 21 so that once the outer edge of the cup is turned in, the force of the nose on the assembly is transmitted through the closed-in end to the copper core 21 to transmit an axial extrusion force on the assembly through the core. This minimizes any tendency for voids to occur at the opposite end of the core.

As best illustrated in FIG. 1*h*, a degree of backward extrusion occurs. During this extrusion, part of the nickel of the cup flows up around the nose 43, to produce a cup-shaped end or tubular section 47. As the part is pressed through the extrusion die, its diameter is reduced by about 50% and an elongated shank or stem 48 is provided in which a core 49 is totally encapsulated within the cladding material, such as nickel 51. Because of the concentration of pressure produced by the nose 43 on the end wall at 52, complete closure occurs and it is believed that there is a tendency to produce a pressure weld.

It is important to ensure that gas or other contaminants are not entrapped within the cup 14 during the initial deformation so the punch is provided with an axial vent opening 53 illustrated in exaggerated size in FIG. 2. Any lubricant or gas or other contaminant which might otherwise be encapsulated with the core is vented through the vent opening 53 as the cup is closed in around the core.

It should be noted from FIG. 1*h* also that there is no void at the inner end 54 of the core 49 and that intimate contact is provided between the core material and the adjacent cladding material. This absence of a void is accomplished in part by each of two processes. First, during the preseating operation, the core 21 is fully seated against the inner surface of the cup 14 as illustrated in FIG. 1*f*. Second, the size of the nose 43 is arranged so that the greatest pressure tending to initiate the extrusion is applied along an area substantially equal to the area of the initial slug 21 so that the force required to commence the extrusion is transmitted through the slug 21 to the lower wall of the cup.

Figure 1I:
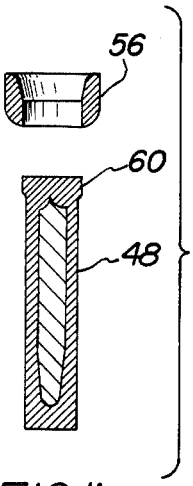
Figure 1J:
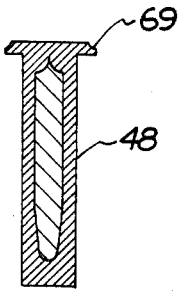
Figure 1K:
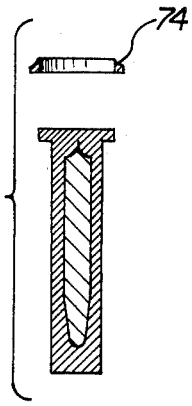

In one form of the first embodiment illustrated in FIGS. 1*i* through 1*k* and in FIG. 2, the next operation is to trim the tubular extension 47 of the cladding material which is caused by backward extrusion around the nose 43. Such trim 56, FIG. 1*i*, is removed by pressing the extruded part formed in the extrusion die assembly 31 into a trim die 57 which includes an outer die 58 having a through bore 59 with the diameter equal to the diameter of the shear part 60 illustrated in FIG. 1*i*. The trim 56 is removed from the part as it is pressed into the die by a tool 61. After the trimming operation, a stripper sleeve 62 ensures that the scrap 56 is not retained on the tool 61 as it is retracted from the forward dead-center position.

After the completion of the operation in the second or trimming die, a knock-out pin 63 ejects the trimmed part and it is transferred to a coining die 66 having a central passage 67 proportioned to receive the stem 48. A flat tool 68 engages the head portion and laterally upsets the head along the face of the die 66 to produce an enlarged head 69 as illustrated in FIG. 1*j*. In this coining operation, the underside of the head 69 is well-defined with a controlled surface.

In the final operation, the part is again trimmed in a trim die 71 to the final shape illustrated in FIG. 1*k*. Here again, a tool 72 and a stripper 73 cooperate to trim away a ring of scrap material 74, illustrated in FIG. 1*k*, and to square off the outer edges of the head portion 69. The stripper 73 again functions to ensure that the scrap does not remain on the tool 72 as it is retracted.

Figures 3A, 3B, 3C:
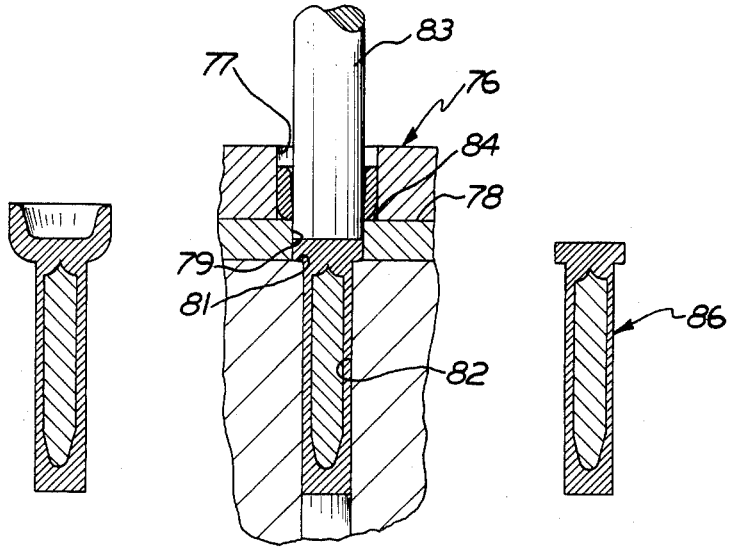
FIGS. 3*a* through 3*c* illustrate a modified trimming and coining system in which the part of FIG. 1*h* can be worked to the part of FIG. 1*k* in a single operation and within a single set of dies.

FIGS. 3*a* through 3*c* illustrate a variation of the first embodiment in which the trimming and coining operation are performed in a single die. In such instance, the part illustrated in FIG. 3*a* is the same as the part illustrated in FIG. 1*h* which is completed in the extrusion die. Such part is placed in a combined die 76 which functions to trim away the excess material and also provide the coining operation. Such die is provided with an outer die member having a bore 77 proportioned to receive the tubular section 47. Inwardly of the die 76, a second die member 78 is provided with a through bore 79 having a diameter equal to the required maximum diameter of the headed portion of the electrode. Such bore extends to a flat shoulder at 81 provided by a second inner die having a through bore 82 with a diameter sized to closely fit the shank 48.

As the extruded part is pressed into the die 78 by a tool 83, the portion which will result in scrap enters the bore 77 and is sheared from the blank by its engagement with the shoulder 84. The sheared blank is then pressed on into the die 78 and the headed portion is coined against the shoulder 81 and upsets to a well defined head within the bore 79. Thus, in the die illustrated in FIG. 3*b*, a finished electrode 86 is produced in a single operation from the extruded part of FIG. 3*a*.

A second embodiment of this invention is disclosed for producing a spark plug electrode in which the core material is not completely encapsulated. Such embodiment employs a progression as illustrated in FIGS. 1*a* through 1*f* followed by the progression of FIGS. 4*a* through 4*d*. In such embodiment, the cup 14 is formed in the manner illustrated in FIGS. 1*a* through 1*c*. Similarly, the slug 21 is formed as illustrated in FIG. 1*d*, assembled as illustrated in FIG. 1*e*, and preseated as illustrated in FIG. 1*f*. However, in the second embodiment the assembly is not bottled but is transferred directly to the extrusion die in which the extrusion 101 is produced.

Figures 4A, 4B, 4C, 4D:
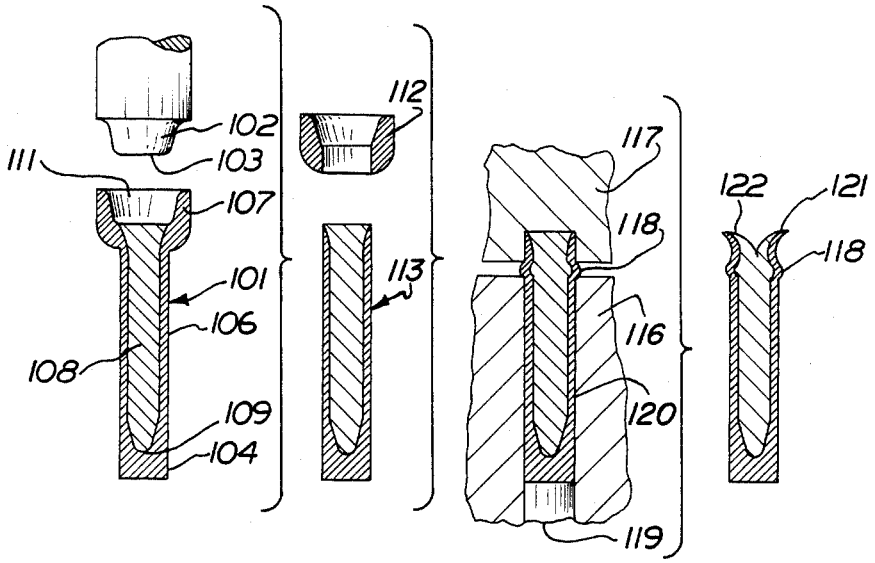
FIGS. 4*a* through 4*d* illustrate the progression of an embodiment in which the core material is not fully encapsulated.

The tool and die for producing the exrusion 101 illustrated in FIG. 4*a* is essentially that same as the tooling used to produce the extrusion illustrated in FIG. 1*h*. However, since the part has not been previously bottled, the nose 102 of the punch fits down into the open end of the cup 14 and engages the end of the core slug 21. The length of the nose 102 is selected so that the end face of the copper core 21 is engaged by the end face 103 of the nose 102 before the punch bottoms out on the cup to ensure that a substantial force is applied to the end wall 16 of the cup through the core 21 as the extrusion commences. With such an arrangement, the tendency for a void to appear at the inner end of the core is substantially reduced.

At the completion of the extrusion operation, the extruded part is provided with a closed inner end wall 104, a cylindrical side wall 106, and an enlarged diameter tubular section 107, all formed of the material of the cup 14. The core 21 is elongated to provide a core section 108 extending from an inner end 109 to an exposed end surface 111.

In the illustrated second embodiment, it is desired to produce an electrode an illustrated in FIG. 4*d*. This is accomplished by inserting the extruded part 101 into a trim die similar to the die assembly 57, where a tubular section of scrap 112 is sheared from the upper end of the extruded part, leaving a bimetal element 113 which is of uniform outside diameter. After the shearing operation, the bimetal part 113 is partially upset, as illustrated in FIG. 4*c*, between a die 116 and a punch 117 to form an enlarged rib 118 intermediate its ends. A knockout pin 119 supports the inner end of the part during the upsetting operation and functions to eject the ribbed part 120 as the tool 117 moves back from the die 116. In the last operation illustrated in FIG. 4*d*, two or more cross-slots are formed in the open end of the part to produce anchoring pedals 121 and 122 which cooperate with the rib 118 to provide a structure for securing the electrode in a spark plug.

A progression of a third embodiment is illustrated in FIGS. 5*a* through 5*d*. This embodiment is similar to the first embodiment, but is modified to provide a central weld lug along with full encapsulation.

Figure 5A:
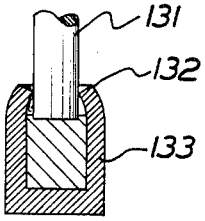
FIGS. 5*a* through 5*d* illustrate the progression of an embodiment in which the core material is again fully encapsulated but in which a weld lug is also provided.
Figure 5B:
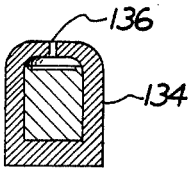
Figure 5C:
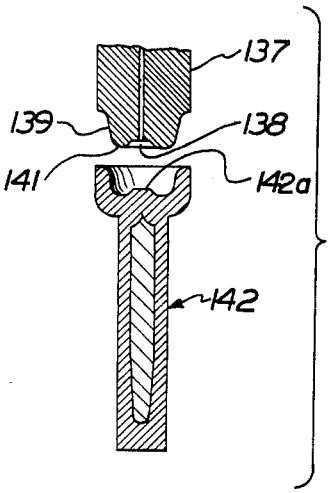

In this embodiment, the cup and core are again formed as illustrated in FIGS. 1*a* through 1*d*, and after cleaning, the two are assembled. Preferably, the cup is bottled slightly during assembly, as illustrated in FIG. 5*a*, to secure the core in place. Then, the core is preseated with a tool 131 sized to fit through the slightly bottled end 132 of the cup 133. Subsequently, further bottling is performed to produce the combined blank 134 illustrated in FIG. 5*b*. In this embodiment, a greater amount of bottling is performed than in the first embodiment, so that only a small opening 136 remains at the open end of the cup.

Subsequently, the extrusion is performed by a tool 137, which differs from the tool 41 of FIG. 1*h* in that it is provided with a small central recess 138 in the reduced diameter nose 139. Around the recess 138, the nose 139 is formed with a flat, annular end face 141 having substantially the same size relationship described above in connection with the tool 41. At the completion of the extrusion operation, the blank 142 has substantially the same shape as illustrated in FIG. 1*h*, except that it includes a central, axially projecting weld lug 142*a*.

Figure 5D:
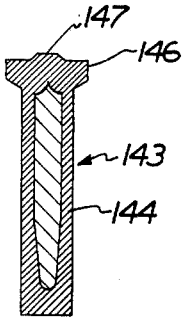

The extruded blank is then trimmed and the underside of the head is coined to produce the finished part 143 of FIG. 5*d*. Such part has a bimetal shank 144, a head 146, and a weld lug 147 projecting from the face of the head 146. Further, the core is fully encapsulated.

In each of the embodiments illustrated, the cup and slug or core are formed so that the core does not project beyond the open end of the cup when the two are assembled. Preferably, the core is then preseated to ensure that a gap does not exist between the end wall 16 of the cup 14 and the inner end of the core. In the instance of the second embodiment, this also locks the two parts together so that they can be transferred and automatcially fed into the machine in which the extrusion occurs without danger of the core dropping out of the cup. The bottling operation of the first and third embodiments, on the other hand, also prevents this occurence, even if a presetting operation were not provided.

In the embodiments in which full encapsulation is provided, the extrusion is produced by a punch having a relatively small diameter nose which operates to produce extremely high pressures along the inturned edges of the cup or outer metal to ensure a full closure for the full encapsulation of the core, and also to ensure that a gap or void does not occur at the opposite end of the core at the commencement of the extrusion operation. Further, in order to ensure that no voids exist and that a good contact is accomplished along the interface between the core and the cup, it is important that the two parts be thoroughly cleaned before assembly and that any foreign matter and lubricant be removed insofar as possible.

It is contemplated that this invention is to be performed in separate machines. For example, a double blow header may be used to produce the cup 14 and a separate shear may be used to produce the slug or core 21. An assembly machine may be provided for the automatic assembly of the core 21 in the cup after both are cleaned. Such assembly machine may also be used for the preseating operation and, if utilized, the bottling operation, although the bottling can be performed in a machine which performs the subsequent operations. Lastly, the extrusion and subsequent trimming and forming operations can be performed in a final separate machine. Although it is contemplated to utilize separate machines for the purposes of performing the process and method in accordance with this invention, it should be understood that combined machines may be developed and that substantial modifications of the various steps may be encompassed within the broader aspects of the present invention.

Although the preferred embodiments of this invention have been shown and described, it should be understood that various modifications and rearrangements of the parts may be resorted to without departing from the scope of the invention as disclosed and claimed herein.

What is claimed is:

1. A method of forming bimetal electrodes for spark plugs or the like, comprising forming an outer metal cup having an open end and a closed end, positioning a cylindrical core of a different metal within said cup so that said core does not project beyond said open end, pressing said cup and core through an extrusion die with said closed end first by applying a force primarily through said core to said closed end to produce a compound extrusion in which intimate contact is provided between the inner end of said core and the closed end of said cup.

2. A method as set forth in claim 1, wherein at the completion of the extrusion operation, a part is produced having a shank and an enlarged head at the end thereof opposite said closed end, and thereafter a ring-shaped portion of said head is trimmed from the part.

3. A method as set forth in claim 2, wherein the underside of said head is coined during the trimming thereof.

4. A method as set forth in claim 1, wherein after extrusion a part is produced having an extruded shank and an enlarged end, and the underside of said enlarged end is thereafter coined.

5. A method of forming bimetal electrodes as set forth in claim 4, wherein at the end of said extrusion a weld lug is formed on said enlarged head.

6. A method of forming bimetal electrodes as set forth in claim 1, wherein said core is preseated in said cup prior to said extrusion so that it mates with and engages the adjacent surfaces of said cup.

7. A method of forming bimetal electrodes as set forth in claim 1, wherein a portion of said outer metal is backward-extruded around said end face of said tool to form a tubular portion.

8. A method of forming bimetal electrodes as set forth in claim 7, wherein said tubular portion is subsequently trimmed away.

9. A method of forming bimetal electrodes as set forth in claim 8, wherein a head is formed adjacent to one end.

10. A method of forming bimetal electrodes as set forth in claim 1, wherein said force is initially applied in alignment with said central opening and over an area no greater than the area of said central opening.

11. A method of forming bimetal electrodes as set forth in claim 10, wherein said force is applied by a tool having a reduced diameter nose, and said first metal is also extruded back around said nose to form a tubular portion.

12. A method of forming bimetal electrodes as set forth in claim 11, wherein said tubular portion is trimmed away leaving an enlarged portion adjacent to said fully closed end.

13. A method of forming bimetal electrodes as set forth in claim 1, wherein said force is applied primarily through said core by a tool having an end face which is at least substantially as small as said central opening.

14. A method of forming bimetal electrodes as set forth in claim 13, wherein after extrusion a portion of said first metal remote from said closed end is trimmed from said extrusion.

15. A method of forming bimetal electrodes as set forth in claim 14, wherein said portion of said first metal is substantially tubular.

16. A method of forming bimetal electrodes as set forth in claim 15, wherein said extrusion is upset at the end thereof opposite said closed end.

17. A method of forming bimetal electrodes as set forth in claim 1, including the steps of terminating the extrusion while a portion of the cup remains unextruded, and thereafter reducing the diameter of the unextruded portion by shearing a ring-shaped portion of metal therefrom.

18. A method as set forth in claim 1, wherein at the completion of the extrusion operation, a part is produced having a shank and an enlarged head at the end thereof opposite said closed end, and thereafter a ring-shaped portion of said head is trimmed from the part.

19. A method of forming bimetal electrodes for spark plugs or the like, comprising forming a first metal into a cup having a wall surrounding a central opening which extends from an open end to a closed end, forming a core from a second and different metal, positioning said core in said central opening with said core recessed back from said open end, bottling said cup to deform the wall of said cup adjacent to said open end inwardly and to at least partially close said open end around said core, and simultaneously extruding said core and cup by applying a force against said partially closed open end, said force, in addition to causing said extrusion, also fully closing said open end to fully encapsulate said core, said force being initially applied along an annular zone to cause a weld lug to be formed centrally of said zone.

20. A method as set forth in claim 19, wherein the end of the tool is so shaped that it applies the force which causes the weld lug to be formed.

21. A method as set forth in claim 19, wherein, before the extrusion of the composite billet but after the composite billet has been formed, the right circular cylindrical core and the cup are forced into close fitting engagement.

22. A method of forming bimetal electrodes for spark plugs or the like, comprising forming a first metal into a cup having a wall surrounding a central opening which extends from an open end to a closed end, forming a core from a second and different metal, positioning said core in said central opening with said core recessed back from said open end, deforming the wall of said cup adjacent to said open end inwardly to close said open end at least partially around said core, and simultaneously extruding said core and cup by applying a force against said partially closed open end, said force, in addition to causing said extrusion, also fully closing said open end to substantially encapsulate said core, said force being initially applied along an annular zone to cause a weld lug to be formed centrally of said zone.

23. An electrode for spark plugs or the like, comprising a core formed of a first metal, and an outer corrosion-resistant metal completely encapsulating said core, said electrode being formed by seating the core metal within a cup shape body of said outer metal to form a composite cup, extruding cup end first the composite cup partly through an extrusion die while maintaining substantially complete contact between said cup end and the core metal and shaping the unextruded open end of the cup to encapsulate the core and to form a centrally located protruding weld lug of said outer metal opposite the extruded cup end.

* * * * *